US008647469B2

(12) United States Patent
Trolin et al.

(10) Patent No.: US 8,647,469 B2
(45) Date of Patent: Feb. 11, 2014

(54) METHOD, SYSTEM AND WITHDRAWAL SCREEN SECTION FOR IMPREGNATING CHIPS

(75) Inventors: Daniel Trolin, Camacari (BR); Hans Furhem, Skoghall (SE)

(73) Assignee: Metso Paper Sweden AB, Sundsvall (SE)

( * ) Notice: Subject to any disclaimer, the term of this patent is extended or adjusted under 35 U.S.C. 154(b) by 0 days.

(21) Appl. No.: 13/817,556

(22) PCT Filed: Aug. 25, 2010

(86) PCT No.: PCT/SE2010/050915

§ 371 (c)(1), (2), (4) Date: May 23, 2013

(87) PCT Pub. No.: WO2012/026856

PCT Pub. Date: Mar. 1, 2012

(65) Prior Publication Data

US 2013/0240167 A1 Sep. 19, 2013

(51) Int. Cl.
*D21C 3/26* (2006.01)

(52) U.S. Cl.
USPC ..... 162/17; 162/19; 162/237; 162/141

(58) Field of Classification Search
USPC ..... 162/141, 19, 52, 68, 237, 239, 246, 250
See application file for complete search history.

(56) References Cited

U.S. PATENT DOCUMENTS

| | | | | |
|---|---|---|---|---|
| 3,881,986 | A * | 5/1975 | Backlund | 162/19 |
| 7,381,302 | B2 | 6/2008 | Snekkenes | |
| 7,901,541 | B2 * | 3/2011 | Snekkenes et al. | 162/17 |
| 2010/0051222 | A1 * | 3/2010 | Turqueti | 162/237 |
| 2011/0067828 | A1 * | 3/2011 | Turqueti | 162/19 |

FOREIGN PATENT DOCUMENTS

| | | |
|---|---|---|
| SE | WO2006006934 | 1/2006 |
| SE | WO2010024764 | 3/2010 |

* cited by examiner

*Primary Examiner* — Mark Halpern
(74) *Attorney, Agent, or Firm* — Rolf Fasth; Fasth Law Offices

(57) ABSTRACT

The method, system and a withdrawal screen section are for the impregnation of chips during the manufacture of chemical pulp. Chips are both steamed and impregnated in a low pressure impregnation vessel, using pressurized hot spent cooking liquor BL as the main part of the impregnation liquid. The hot spent cooking liquor produces most of the steam $BL_{ST}$ necessary for steaming the chips. At least two independent first and second screen rows, SC1 and SC1*b* respectively, are installed in order to improve the process in the impregnation vessel. The first screen row withdraws acidified treatment liquor for disposal which otherwise would be a parasitic acidified waste fluid in the system. The second screen row recirculates treatment fluid back to center of treatment vessel in order to even out the pH profile over the cross section of the vessel.

14 Claims, 5 Drawing Sheets

WL
REC1
BWF
DL
6
SC3
SC4
7
51
SC2
M3
52
M2
40
41
13a
13b
CHLEV
3
2
20
SC1
4
10
12a
M1
41d
11
LIQLEV
ST
42
12b
1
REC2

METHOD, SYSTEM AND WITHDRAWAL SCREEN SECTION FOR IMPREGNATING CHIPS

PRIOR APPLICATION

This application is a U.S. national phase application that is based on and claims priority from International Application No. PCT/SE2010/050915, filed 25 Aug. 2010.

TECHNICAL FIELD

The present invention concerns impregnation of chips during the manufacture of chemical pulp.

BACKGROUND AND SUMMARY OF THE INVENTION

In conventional continuous cooking has a pre-treatment arrangement with a chip bin been used, in which a first heating of the chips by low pressure steam to a temperature of 70-100° C. is carried out. A steam-treatment in a steam vessel follows the pre-treatment in which the chips are intensely heated with flash steam and/or live low pressure steam to 110-120° C. The thoroughly steamed chips are then slurried in a chip chute before being fed to the cooking process. This process requires large quantities of steam as well a number of expensive treatment vessels adding cost and complexity into the cooking system.

The extensive steam treatment and its implementation in several treatment vessels has been considered to be totally necessary in order to be able ensure that air and water bound to the chips are expelled, such that the impregnation fluid can fully penetrate the chips and such that air is not drawn into the digestion process with the chips.

Attempts have been made to integrate the chip bin with the impregnation vessel such that a simple system is in this way obtained.

Metso Fiber Karlstad AB's U.S. Pat. No. 3,532,594 shows a combined vessel in which steam treatment and the formation of a slurry take place in a single pressure vessel that is maintained at an excess pressure of 1-2 atmospheres. The system was used in a pulp plant in Sweden as early as the 1970s. In this case, an impregnation fluid is recirculated during the addition of black liquor that maintains the suggested temperature of 105° C. in a circulation that consists of withdrawal strainer (35)—pump (23)—heat exchanger (25)—outlet/central pipe (27). Steam flashed off from black liquor in a flash tank was also added in an additional central pipe together with an optional addition of fresh steam. The idea in this case was that all water vapour would be expelled through the superior bed of chips by steam, and that this water vapour could be withdrawn (ventilated) through the outlet 12. A powerful heat exchanger (25) was required in this system. There is a serious risk of malodorous non-condensable gases (NCGs) leaking out, via the inlet 13. It is also specified in this patent that it would be possible to remove totally the addition of steam and have only a reinforced indirect heating of the chips with the aid of a heating flow during the addition of black liquor. It is difficult to implement this heating technology since it requires very large recirculation flows and a large heating power in the heat exchanger in order to be able to heat the cold chips.

U.S. Pat. No. 5,635,025 shows a system in which chips are fed without a preceding steam treatment into a vessel in the form of a combined chip bin, impregnation vessel and chip chute. Steam treatment of the chips that lie above the fluid level takes place at this location by the addition of steam from a "steam source", as does a simple addition of impregnation fluid in the lower part of the vessel.

U.S. Pat. No. 6,280,567 shows a further such system in which the chips are fed without preceding steam treatment into an impregnation vessel at atmospheric pressure where the chips are heated by the addition of hot black liquor that maintains a temperature of approximately 130-140° C. The hot black liquor is added just under the fluid level via pipes in the wall of the impregnation vessel and excess liquid is only drained from the slurry in an external steaming vessel.

SE 523850 shows an alternative system in which hot, pressurised black liquor taken directly from the digester at a temperature of 125-140° C. is added to the upper part of the steam-treatment vessel, above the fluid level but under the level of chips, whereby the black liquor whose pressure has been relieved releases large quantities of steam for the steam treatment of the chips that lie above the fluid level established in the vessel. Excess fluid, the black liquor, can in this case be withdrawn from the lower part of the vessel.

Thus, prior art technology has in most cases used steam treatment as a significant part of the heating of the chips, where the steam that is used is either constituted by fresh steam or by steam that has been obtained following pressure reduction of black liquor from the cooking step, the latter containing large amount of sulphur laden NCG gases. This ensures a relatively large flow of steam, with the associated consumption of energy, and it requires a steam-treatment system that can be controlled.

The steam treatment has also involved the generation of large quantities of malodorous gases, i.e. NCG gases, with a high risk of explosion at certain concentrations.

U.S. Pat. No. 7,381,302 (or U.S. Pat. No. 7,615,134) shows an arrangement in an attempt to avoid excessive volumes of steam flowing trough the chip bed. Impregnation fluids (BL1/BL2/BL3) are in this case added with increasing temperatures at different positions (P1, P2, P3) where the local pressure may be above the boiling point of the added liquor. Most of the volatile compounds in the black liquor added are bound to the withdrawn impregnation fluid (REC).

In SE 530725 (=US2009139671) is a further improvement of atmospheric impregnation vessels using hot black liquor shown. Here are knock down showers installed above the chip level in order to prevent blow trough of malodorous NCG gases.

It has surprisingly become apparent that the use of an atmospheric impregnation vessel, using hot alkaline black liquor for the major part of the steaming effect of chips, releases large quantities of wood acidity in the chips. In recent tests in impregnation of chips has as much as 1.5 $m^3$/BDt wood of acidified liquid with no or neglectable residual alkali been withdrawn from early screen sections in the impregnation vessel. This large volume of acidified liquid with low residual alkali was found to have a distinct reddish terracotta colour quite different in colour than regular spent black liquor from alkaline cooks, as well as having a sticky malodorous scent. There are a number of possible cures for this situation, but most of them results in increased alkali losses in the withdrawn spent impregnation liquid. A problem associated with the low residual alkali level in the withdrawn spent impregnation liquid is that the chips close to the wall of the impregnation vessel, close to withdrawal position, are impregnated with the same liquid as last withdrawn from vessel. The chips close to the wall are thus not impregnated at requested alkaline conditions as the chips close to centre of impregnation vessel, which results in uneven impregnation conditions over the cross section of the vessel.

Another problem is that the released wood acidity brings about a dissolution of metal from the wood material due to acidic conditions, which content of metals is cumbersome for the subsequent process. Especially calcium has a tendency to form scaling in the equipment in form of calcium carbonate, said scaling activated by high temperature.

Yet another problem is that the large volumes of acidic fluid need a lot of alkali only for neutralization of the acidity. This creates further alkali consumption in the cooking process.

The principal aim of the present invention is to achieve an improved method and an improved system for the impregnation and heating of chips that have not been steam-treated, which method and system reduce the problems with formation of large volumes of acidic condensates during steaming.

A second aim is to reduce the amount of metals being brought into the cooking process early in the process, thus reducing the risk for scaling problems.

A third aim is to reduce the total alkali charge in the cooking process, such that a minimum amount of alkali is needed to neutralise the wood material after steaming.

A fourth aim is to establish even impregnation conditions at alkali conditions for the chips directly after steaming and preferably in the very same vessel as used for steaming.

The inventive method for the impregnation and steaming of chips during the manufacture of chemical pulp comprises following steps a to e;

Step a: chips are continuously fed without preceding steam treatment to the top of an impregnation vessel where impregnated chips are fed out from the bottom of the vessel. The chips are thus in the original state having its natural content of wood acidity.

Step b: hot impregnation fluid at a first temperature above the boiling point of the hot impregnation fluid is added to the impregnation vessel (3), via a pipe having the outlet end located below a chip level ($CH_{LEV}$) established in the impregnation vessel and at a distance from the walls of the impregnation vessel, preferably in the centre, such that steam is released into the chip volume for steaming the chips. The impregnation fluid thus has a temperature above the boiling point at the prevailing pressure established in the impregnation vessel, which will generate steam during pressure release inside the impregnation vessel.

Step c: the impregnation fluid added establishes a fluid level in the impregnation vessel and where the chip level lies at least 1-2 meters, preferably 3-5 meters, over the fluid level and where the pressure at the top of the impregnation vessel that is essentially at the level of atmospheric pressure, ±0.5 bar(g) preferably ±0.2 bar(g). These are conditions that guarantee a low temperature in the vessel for the impregnation vessel and a steam release trough the pile of chips for steaming effect.

Step d: that a withdrawal of a first impregnation fluid for a first use takes place from the vessel at the level of the fluid level, from a first withdrawal volume located behind a first screen row mounted in the wall of the impregnation vessel. This withdrawal will extract most of the early steam condensate.

Step e: according to the inventive method is also an additional withdrawal of a second impregnation fluid taking place from the vessel at a level below the first screen row, from a second withdrawal volume located behind a second screen row mounted in the wall of the impregnation vessel, said level below the first screen row not exceeding the diameter of the impregnation vessel, and wherein the second impregnation fluid at least in part is returned into the centre of the impregnation vessel which is of different use than the first use of the first impregnation liquid. This method using two screen rows and recirculation of the last withdrawn liquid at least in part to centre of vessel will enable withdrawal of the large volumes of acidified treatment fluid from treatment vessel, containing dissolved metal ions and wood extractives such as to turpentine etc., thus avoiding need for alkali for neutralisation of these wood acidity, and the subsequent circulation could establish an even alkali profile over the cross section of the impregnation vessel for an even impregnation process of the wood chips.

According to a preferred embodiment of the inventive method is the first use for being part in the liquor flow sent to recovery, and not being part of fluid returned into the centre of the impregnation vessel. As this acidified waste flow contains less valuable content, as of cellulose or hemicelluloses, for the alkaline cooking process it is beneficial for an early extraction of this acidified liquid volume. It could be merged with other black liquor flows and sent to the recovery boiler, or merged with other acidic waste liquors from the bleach plant for further appropriate recovery of chemicals or fibre content.

According to another preferred embodiment of the inventive method is the amount of hot impregnation fluid fed in to the impregnation vessel in association with the fluid level exceeding 3 tonnes per tonne of wood and at a temperature of the impregnation fluid in the interval 115-170° C., such that the temperature of the fluid-wood mixture that is established at the fluid level is established within the interval 90-115° C., preferably within the interval 95-105° C., and where the level of alkali of the added impregnation fluid exceeds 15 g/l EA as NaOH. These amounts of hot alkaline liquor would supply all or most of the steam and alkali needed for the impregnation process.

According to yet another preferred embodiment of the inventive method is the amount of second impregnation fluid withdrawn exceeding 0.5 tonnes per tonne of wood and at least a part of this withdrawn second impregnation fluid is recirculated back to the centre of the impregnation vessel. Preferably could as much as 1.0 to 2.0 tonnes be withdrawn, and larger flows will establish a stronger circulation rate.

From this withdrawn amount could a part of the second impregnation fluid be returned into the centre of the impregnation vessel, and preferably at least 0.5 tonnes per tonne of wood. So if in total 0.5 tonnes is withdrawn could the entire volume be returned, and if in total 1.0 tonnes is withdrawn could half the volume be returned, hence always at least a part of the total amount is withdrawn and returned into the centre of the impregnation vessel.

According to yet a preferred embodiment of the inventive method could a part of the second impregnation fluid returned into the centre of the impregnation vessel be diluted with additional liquid. This additional liquid is preferably an alkaline wash filtrate from subsequent cooking or bleaching stages having a residual alkali content.

Further the total volume of second impregnation fluid, including any dilution, is preferably returned into the centre of the impregnation vessel below the first screens, and an upwardly directed displacement flow is established towards the first screens. The upwardly directed displacement flow will improve wash out effect of the acidic rest fluids from the preceding steaming effect, and further improve an even alkali profile in the subsequent impregnation process.

The inventive system used for impregnating and steaming chips in one single impregnation vessel during the manufacture of chemical pulp comprises following features. Said impregnation vessel having an inlet at the top for chips and an outlet in the bottom for impregnated chips. Said impregnation vessel having means for adding hot impregnation fluid at a first temperature above the boiling point of the hot impregnation fluid to the impregnation vessel, via a first central pipe having the outlet end located below a chip level established in the impregnation vessel and at a distance from the walls of the impregnation vessel, said outlet end preferably located in the centre, such that steam is released into the chip volume for steaming the chips. Said impregnation vessel further having means for establishing a fluid level by the added impregnation fluid in the impregnation vessel. And further having means for establishing a chip level lying at least 1-2 meters, preferably 3-5 meters, over the fluid level. The impregnation vessel further includes means for establishment of a pressure at the top of the impregnation vessel that is essentially at the level of atmospheric pressure, ±0.5 bar(g) preferably ±0.2 bar(g). Said impregnation vessel having a first screen row at the level of the fluid level comprising a first withdrawal volume located behind the first screen row mounted in the wall of the impregnation vessel for withdrawing spent impregnation fluid.

The inventive system further comprises an additional second screen row located in the impregnation vessel at a level below the first screen row, having a second withdrawal volume located behind the second screen row mounted in the wall of the impregnation vessel. Said level below the first screen row not exceeding the diameter of the impregnation vessel. And further a second withdrawal pipe connected to the second withdrawal volume for extracting spent treatment liquid, and wherein the second withdrawal pipe is connected to a second central pipe having an outlet in the impregnation vessel at a distance from the wall of the impregnation vessel and preferably in the centre of the impregnation vessel.

According to a preferred embodiment of the inventive system is the outlet of the second central pipe located below the first screen row. By having the first and second central pipes arranged at different levels could each central pipe be used to optimize either steam generation, as to the first central pipe, or improved circulation for evening out the alkali profile, as to the second central pipe. In some solutions however could only one single central pipe be used adding a mixed flow of hot impregnation fluid and recirculation fluid.

According to yet a preferred embodiment of the inventive system is a source of dilution liquid connected to the piping (43,41*c*) ending up into the outlet of the central pipe. By adding such source of dilution liquid could enhanced washout performance and a more even alkali profile be obtained.

The inventive withdrawal screen section for use in pretreatment of chips in a liquor-vapour phase treatment vessel having a vapour phase in the top and a liquid phase in the bottom of said vessel comprises following components. Said withdrawal screen comprising, a first screen row mounted in the wall of the treatment vessel and in contact with chips drenched in treatment liquid inside the treatment vessel. Further a first withdrawal volume arranged outside of the first screen row collecting treatment liquid withdrawn from the treatment vessel via said first screen row as well as a first withdrawal pipe connected to the first withdrawal volume for extracting spent treatment liquid via a first pump. The inventive modification comprises further

- an additional second screen row arranged at a level below the first screen row,
- a second withdrawal volume arranged outside of the second screen row collecting treatment liquid withdrawn from the treatment vessel via said second screen row,
- a second withdrawal pipe connected to the second withdrawal volume for extracting spent treatment liquid via a second pump ($P_2$),
- said level below the first screen row not exceeding the diameter of the impregnation vessel, and
- wherein the second withdrawal pipe is connected to a second central pipe having an outlet in the impregnation vessel at a distance from the wall of the impregnation vessel and preferably in the centre of the impregnation vessel.

In a preferred embodiment of the withdrawal screen is the outlet of the second central pipe located below the first screen row.

DETAILED DESCRIPTION OF THE INVENTION

Definitions

The concept "untreated chips" will be used in the following detailed description. "Untreated chips" is here used to denote chips that have not passed through any form of steam treatment or similar, before the chips are fed into an impregnation vessel to be impregnated.

The concepts "fluid level/$LIQ_{LEV}$" and "chips level/$CH_{LEV}$" will also be used. The term "fluid level/$LIQ_{LEV}$" is here used to denote the level that the impregnation fluid added to the impregnation vessel 3 has established in the vessel. The term "chips level/$CH_{LEV}$" is here used to denote the height of that part of the bed of chips (consisting of chips) that is located above the fluid level, $LIQ_{LEV}$.

Prior Art System, Starting Point for Invention

Figure 1:
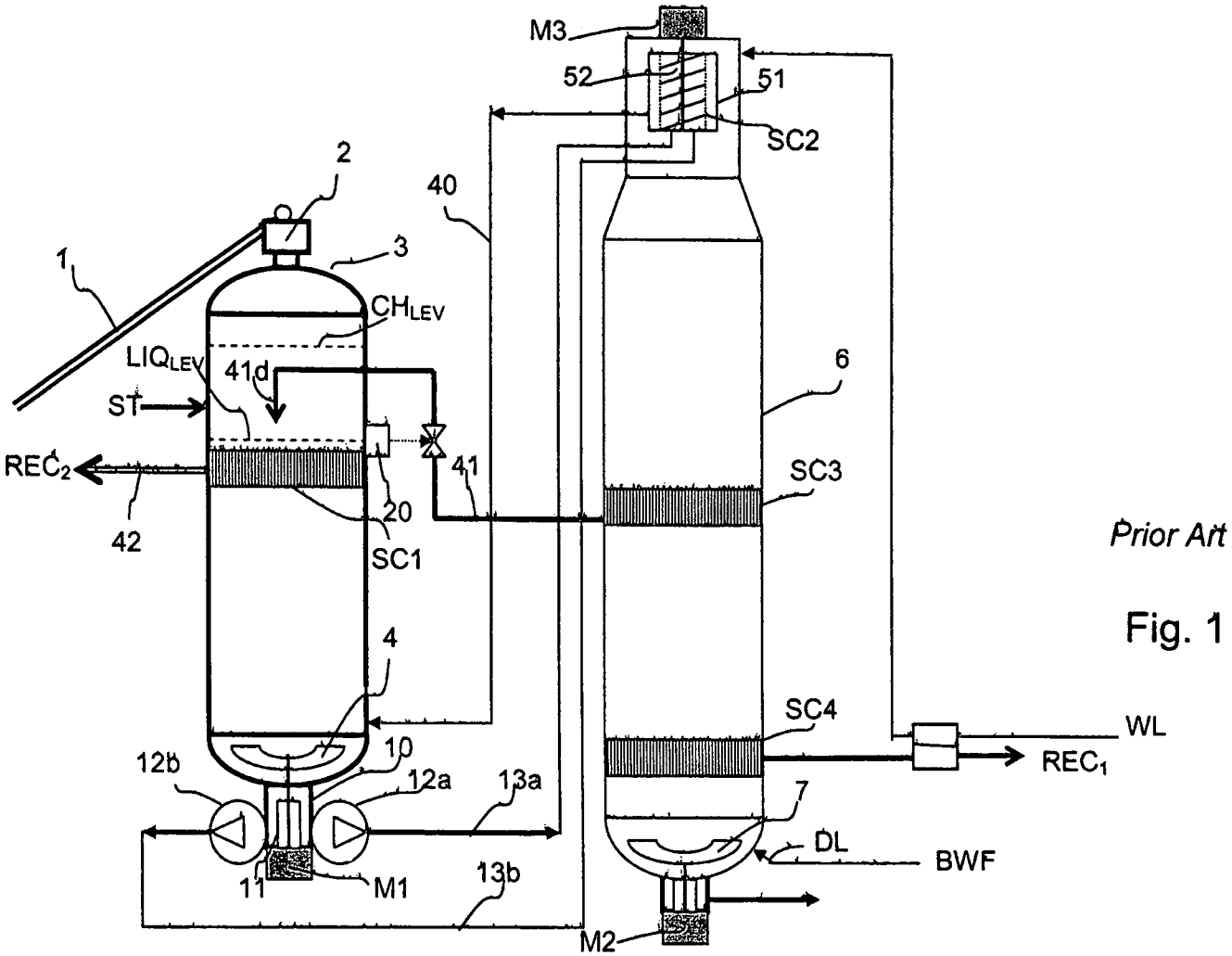
Prior Art Fig. 1
FIG. 1 shows a prior art 2-vessel continuous cooking system with a first atmospheric impregnation vessel.

FIG. 1 shows an arrangement known per se for the impregnation of chips during the manufacture of chemical pulp. The arrangement comprises an essentially cylindrical impregnation vessel 3 arranged vertically, to which non-steamed chips are continuously fed to the top of the impregnation vessel through a feed arrangement, in the form of a conveyor belt 1, and a sluice feed/chip feed 2. When operating the impregnation vessel in the "cold top" mode the temperature at the top of the vessel 3 would essentially correspond to ambient temperature, or slightly above ambient temperature, i.e. up to 20° C. above ambient temperature, but with no active heating of the chips before being fed to the impregnation vessel. A slightly higher temperature than current ambient temperature could be established if for instance the chips are fed from a chip pile where a certain exothermic reaction occurs in the chip pile, or where the chip pile establish some insulation effect which may prevent the same low temperature as that prevailing in the ambient atmosphere.

In some installations in cold climate zones the temperature in the top of the impregnation vessel could lie at some −2° C. while the current ambient temperature is −20° C. In other installations in warm climate zones the temperature in the top of the impregnation vessel could lie at some +35° C. while the current ambient temperature is +30° C.

Additional fresh steam ST may be added if the ambient temperature falls below normal ambient temperature and in such a quantity that a chip temperature within this interval is established. The chips that are fed to the impregnation vessel normally maintain the same temperature as the ambient air temperature or slightly above, i.e. in the range from ambient up to 20° C. above ambient temperature. The chips fed in establish a chips level $CH_{LEV}$ in the upper part of the impregnation vessel.

A feed line 41 with hot impregnation fluid BL is connected to the impregnation vessel in order to establish a fluid level, $LIQ_{LEV}$, consisting of the said impregnation fluid and controlled by level sensor 20 and associated valve in feed line 41. The impregnation fluid is fed in directly in association with the fluid level, $LIQ_{LEV}$, ±1 meter. The impregnation fluid BL is added at a distance from the wall of the impregnation vessel 3, and preferably at the centre of the impregnation vessel. The impregnation fluid BL is fed in to the impregnation vessel in such an amount and at such a temperature that the temperature at the fluid level, $CH_{LEV}$, is established within the interval 90-115° C. and preferably within the interval 95-105° C., whereby evaporation of fluid takes place up into the bed of chips lying above the fluid level, while at the same time steam is not driven through the bed of chips if operating in the cold top mode. The evaporation up into the bed of chips takes place over a distance that preferably does not exceed half of the height of the chips level, $CH_{LEV}$.

The feed line 41 could forward the hot and partially spent hot cooking liquor withdrawn from digester directly to the impregnation vessel.

Alternatively the partially spent hot cooking liquor withdrawn from digester could be added first to bottom of impregnation vessel and mixed with the impregnated pulp before being fed via line 13*a*/13*b* to the top separator 52, and then the liquid withdrawn could be added via the central pipe 41*d*. This method is called Crosscirc™ and promoted by Metso Paper, and implemented in order to save steam for heating in top of digester, as the hot liquid is first used for elevating the temperature of the chips already in the transfer system.

The impregnation fluid BL added is constituted to more than 50% by hot cooking fluid withdrawn from a screen SC3 after use in a cooking zone in a subsequent digester 6, which impregnation fluid BL has an alkali level of at least 15 g/l. The amount of impregnation fluid BL that is added to the vessel 3 lies between 5-10 $m^3$/ADT, preferably between 7-9 $m^3$/ADT, where "ADT" is an abbreviation for "Air-dry tonne" of pulp.

The temperature of the impregnation fluid BL in the feed line 41 maintains a temperature of 115-150° C. and the chips level $CH_{LEV}$ lies at least 1-2 meters over the fluid level and preferably 3-5 meters over the fluid level $LIQ_{LEV}$, in order to facilitate drenching of the chips down into the impregnation fluid, where the chips are thoroughly impregnated. The weight from the chip volume above the fluid level assists in drenching the chips even if some residual air may be caught in the chips.

Given non-steam treated chips that maintain 25° C. with their naturally occurring moisture level, 5 tonnes of fluid that maintains 139° C. are required in order to establish a temperature of approximately 115° C. in the chips mixture at the fluid level. If a temperature of 100° C. is to be established in the chips mixture, given the same basic conditions, 5 tonnes of impregnation fluid that maintains 120° C. is required.

By adding the hot impregnation fluid in association with the fluid level $CH_{LEV}$, most if not all the air present in the chips will be flashed out, and the chips will sink in the impregnation fluid.

A line 42 withdraws spent impregnation fluid and steam condensate, i.e. $REC_2$, from withdrawal screen SC1 in the impregnation vessel 3, at the level of the fluid level $LIQ_{LEV}$.

The pressure in the vessel can be adjusted as required through a regulator valve arranged in a ventilation line (not shown) at the top of the impregnation vessel. The ventilation line may open directly into the atmosphere, for the establishment of atmospheric pressure. It is preferable that a pressure at a level of atmospheric pressure is established, or a slight negative pressure down to −0.2 bar(g) (−20 kPa), or a slight excess pressure up to 0.2 bar(g) (20 kPa).

If necessary, an addition of a ventilating flow (sweep air) may be added at the top, which ventilating flow ensures the removal of any gases. However, this is not to be normally necessary during established operation.

The impregnated chips are continuously fed out through output means, here in the form of an outlet with two pumps 12*a* and 12*b*, combined where relevant with a bottom scraper 4, at the bottom of the impregnation vessel 3. The impregnated chips are thereafter fed to a top separator 51 arranged in the top of a continuous digester vessel 6. The top separator 51 is here shown as an inverted top separator comprising an upwardly feeding screw 52 that feed the chip slurry passed a top separator screen SC2, withdrawing excess impregnation liquid. The drained chips thereafter falls down into the digester vessel 6 and new fresh cooking WL liquor is added. Full cooking temperature is established in the digester either by adding steam or using heating circulations (not shown). According to established practice is most of the fresh cooking WL added to the digester, i.e. 50% or more, and in this example shown as a charge to the top of the digester. As full cooking temperature is established in the cooking zone is the alkali consumption rather high in first stages of delignification, but slows down in bulk and residual delignification stages.

As indicated in previous parts is a hot cooking liquor with a substantial residual alkali level withdrawn via screen SC3 and at least a part of this volume is used as the hot impregnation liquid in the impregnation vessel, either directly or via first usage according to Crosscirc™ as mentioned in previous parts. This position is typically in first half part of the cooking zone or at the end of this part. Here the delignification process has slowed down after the first cooking stage where alkali consumption is high. Thus, for subsequent delignification stages the need for residual alkali is substantially lower than first cooking stage.

In a conventional manner is the cook in the digester 6 ended by a wash zone, comprising dilution nozzles DL for adding wash liquid, typically brown wash filtrate BWF, and a withdrawal screen SC4, where the added wash liquid will displace the hot spent cooking liquor in flow $REC_1$. As colder wash liquid is used, typically brown wash filtrate holds a temperature of 70-100° C., is the withdrawn hot spent cooking liquor $REC_1$ holding a temperature somewhat lower than full cooking temperature, but still with a residual heat content. As shown in FIG. 1 is this residual heat content utilised to heat the fresh cooking liquor WL in a heat exchanger, but after passage of such heat exchanger could the temperature still be well above 100° C.

The Invention

Figure 2:
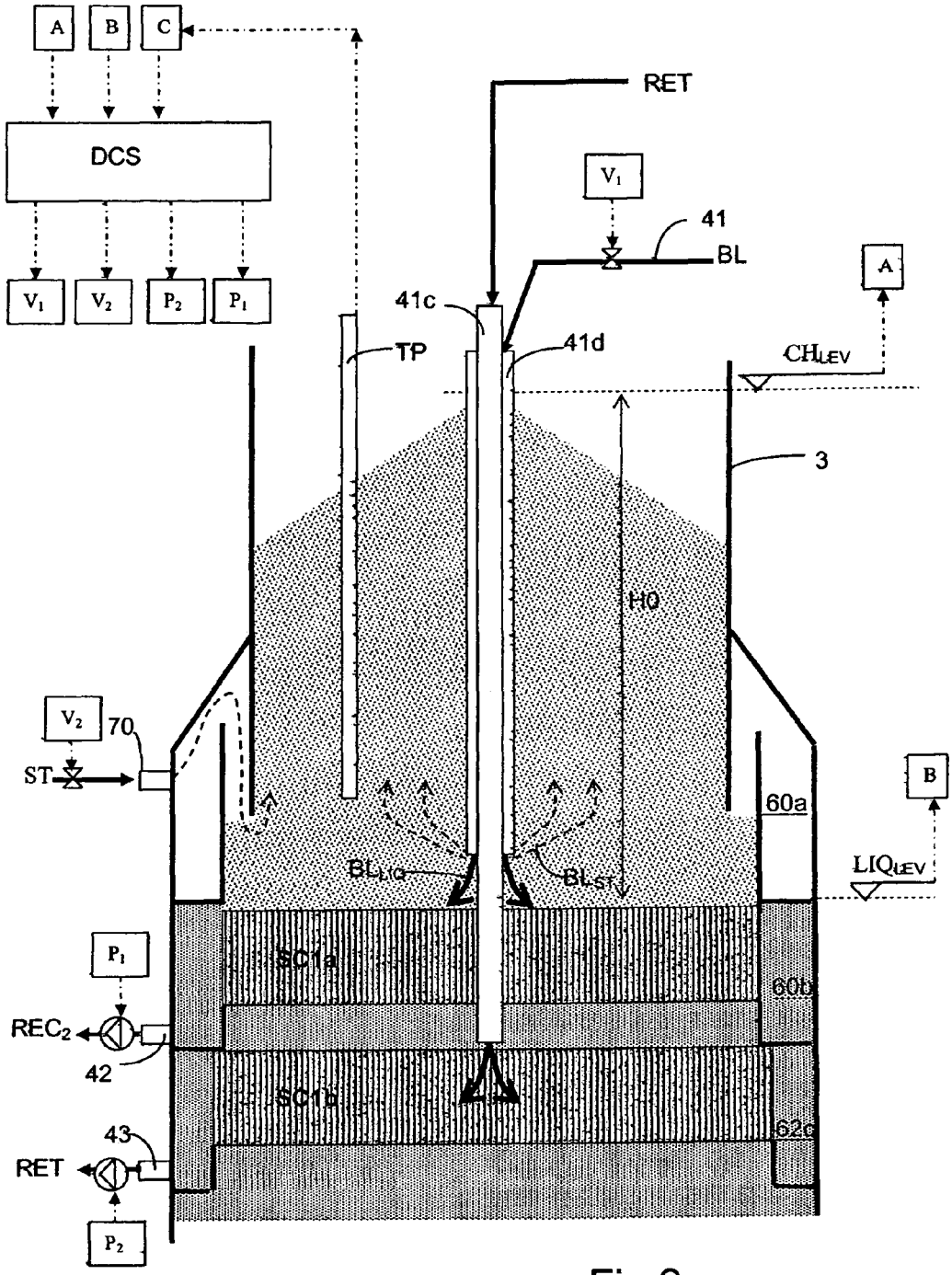
FIG. 2 shows a withdrawal screen section in the atmospheric impregnation vessel according to the invention.

FIG. 2 shows an inventive design of the withdrawal screen SC1 as implemented in a system shown in FIG. 1. Thus, other common features are not described if already described in connection with FIG. 1. Here is shown a vertical cross section of the impregnation vessel 3, with the established liquid level, $LIQ_{LEV}$, and the chip level, $CH_{LEV}$, forming a chip volume with height HO above the liquid level. The control means for maintaining set levels use a conventional Digital Control System, DCS, receiving sensor inputs from level sensors A and B respectively as well as a temperature measuring pole TP, controlling in- and outflow of chips, as well as steam and added liquids. As shown here is the hot impregnation liquid added via a central pipe 41*d*, and steam $BL_{ST}$ flash out from the liquor $BL_{LIQ}$ as it leaves the outlet of the central pipe.

A first screen row SC1*a* with a first withdrawal volume 60*b* is located at the level of the fluid level, $LIQ_{LEV}$. At least one first withdrawal pipe 42 is connected to said first withdrawal volume below the fluid level with means, here shown as a pump $P_1$, for withdrawing liquid from the first withdrawal volume.

According the invention is an additional second screen row SC1*b* is located in the impregnation vessel at a level below the first screen row, having a second withdrawal volume 60*c* located behind the second screen row mounted in the wall of the impregnation vessel, said level below the first screen row not exceeding the diameter of the impregnation vessel. A second withdrawal pipe 43 connected to the second withdrawal volume for extracting spent treatment liquid RET, and wherein the second withdrawal pipe is connected to a second central pipe 41*c* having an outlet in the impregnation vessel at a distance from the wall of the impregnation vessel and preferably in the centre of the impregnation vessel Further, as shown could also at least one additional feed pipe 70 for fresh low pressure steam and/or flash steam be connected to a steam distribution volume 60*a* above the fluid level via a control valve.

Figure 3:
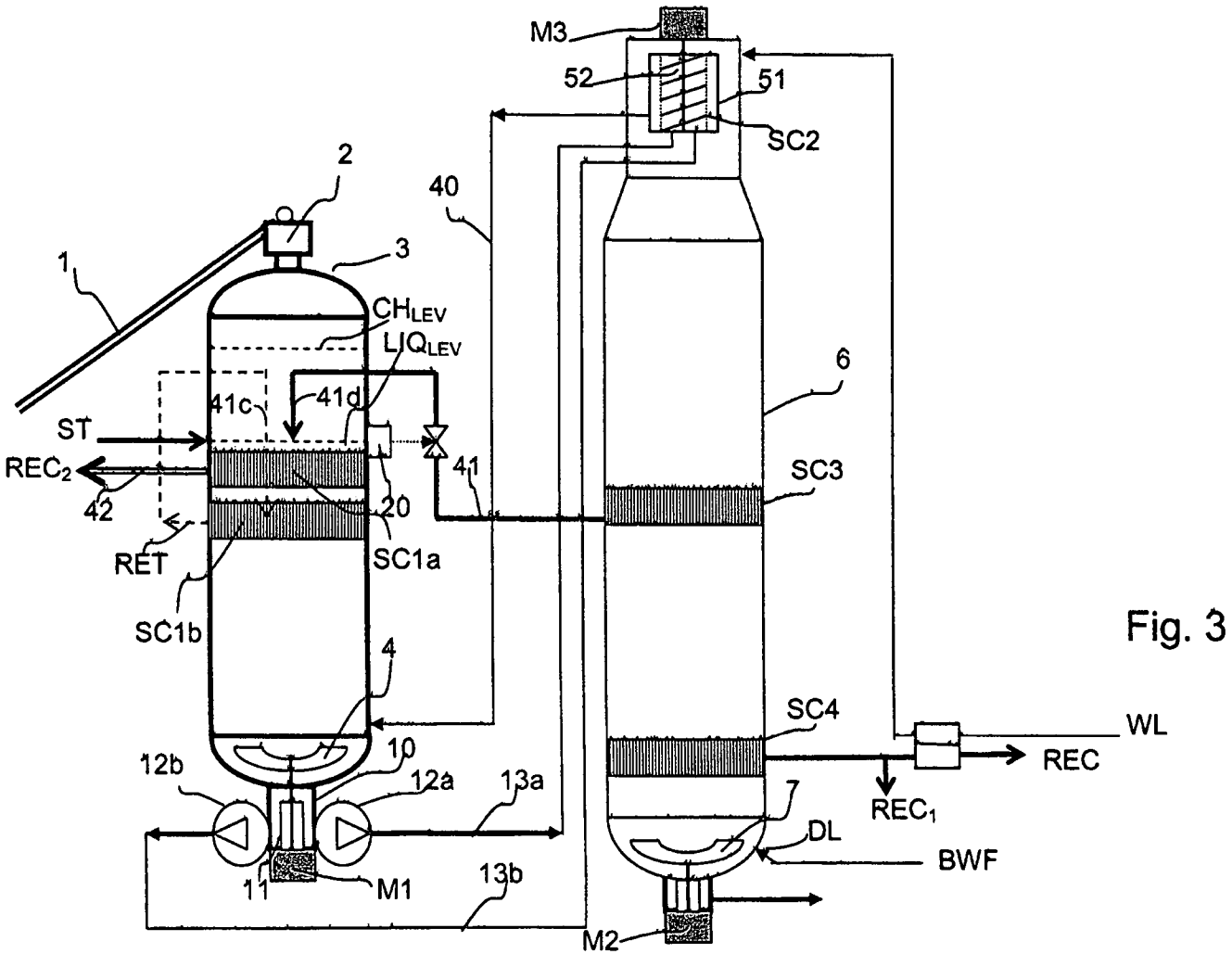
FIG. 3 shows a 2-vessel continuous cooking system using the inventive withdrawal screen section.

In FIG. 3 is shown a digester system having the two sets of withdrawal screens SC1*a* and SC1*b* respectively in the impregnation vessel, and how the liquid flows are handled in the system. Here is shown how the entire amount of withdrawn treatment fluid from second withdrawal screen SC1*b* via central pipe 41*c*, while the entire amount of withdrawn treatment fluid from first withdrawal screen SC1*a* is sent to recovery.

Figure 4:
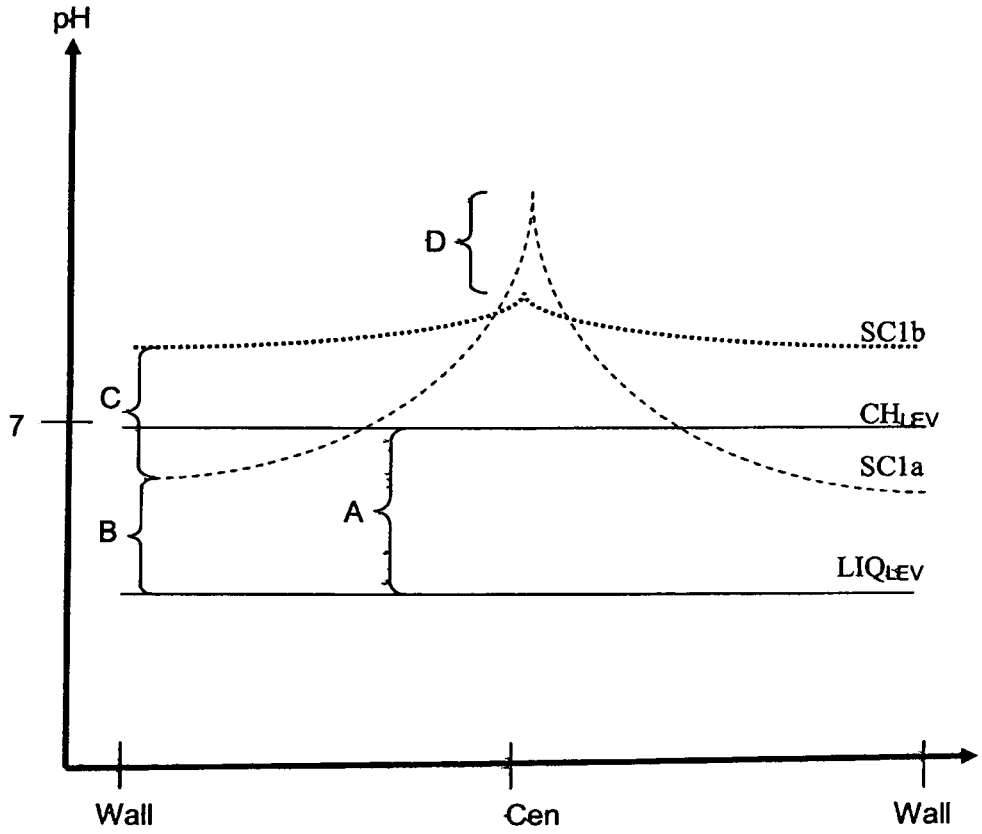
FIG. 4 shows the pH profile established in the impregnation vessel at different heights using the invention.

In FIG. 4 is the alkali profile obtained while using an inventive arrangement with two sets of withdrawal screens SC1*a* and SC1*b* respectively in the impregnation vessel, and following indicators are used:

- $CH_{LEV}$ (unbroken line): shows the pH/alkali level at the surface of the chip level before the chips being exposed to any steaming effect. Here it is indicated that the pH level is about neutral over the entire cross section;
- $LIQ_{LEV}$ (unbroken line): shows the pH/alkali level at the liquid level, i.e. when the acidic condensates have been brought down with the steamed chips. The pH level could easily reach down to about pH4 over the entire cross section. The pH drop is about the distance A in figure, i.e. a drop in pH by about 3-4 units;
- SC1*a* (hatched line): shows the pH/alkali level after the first withdrawal screen SC1*a*, i.e. when the added hot alkaline treatment liquid has been added to centre and a withdrawal of the acidified treatment liquors has been made. The pH level could be quite high in centre in comparison to the alkali level close to the wall/screen. But the pH at the wall has been raised a distance B in figure by this withdrawal.
- SC1*b* (dotted line): shows the pH/alkali level after the second withdrawal screen SC1*b*, i.e. Due to the improved circulation has the pH/alkali level been levelled out such that the pH at the wall has been raised a distance C in figure and the previous high pH level in centre has been reduced a distance D in figure. The established pH profile is thus made more even over the cross section enabling a uniform impregnation process in subsequent impregnation phase in the impregnation vessel.

The pH profiling in FIG. 4 is schematic and show the principles.

If implemented in an impregnation vessel for softwood could as much as 1.5 ton/ton wood of acidified treatment fluid be withdrawn from first withdrawal screen, while 1.0 to 1.5 ton/ton wood of treatment fluid is withdrawn from second withdrawal screen and added back to chip volume by a central pipe. The pH profiling in such an example would reassemble the pH profiling shown in FIG. 4 to a great extent.

If an even pH profiling or reduction of alkali losses should be made following adjustments could be considered;

- The amount of acidified treatment fluid withdrawn from first withdrawal screen could be optimised by controlling the pH of this flow. This could also be monitored visually simply by observing the colour in this liquor. When the reddish colour turns brown is the break point crossed for maximum amount of acidified liquor withdrawn. If more liquid is withdrawn then alkali losses would increase. As indicated above, as much as 1.5 tonne of reddish fluid could be withdrawn in this position for softwood.
- The amount of treatment fluid withdrawn from second withdrawal screen and recirculated back could be optimised by controlling the pH or residual alkali of this flow. The volume of fluid circulated could easily be increased as long as the pH level show an increase as a response to increased volumes recirculated. In this early position of the impregnation vessel it is easy to withdraw liquids as the chip pile is not yet started to be compacted by the delignification. In an established process this will be a trade off between increased pumping effect vs improved alkali profile.
- The alkali losses could be optimised by controlling additional liquid added to the flow recirculated back from the second withdrawal screen. Any additional liquid added could decrease the peak level of pH at centre proportional to amount added. Of course first added amounts would decrease more than last amounts added.
- In general is alkali profile even out as a function of increased recirculation volumes from second withdrawal screen.

Figure 5:
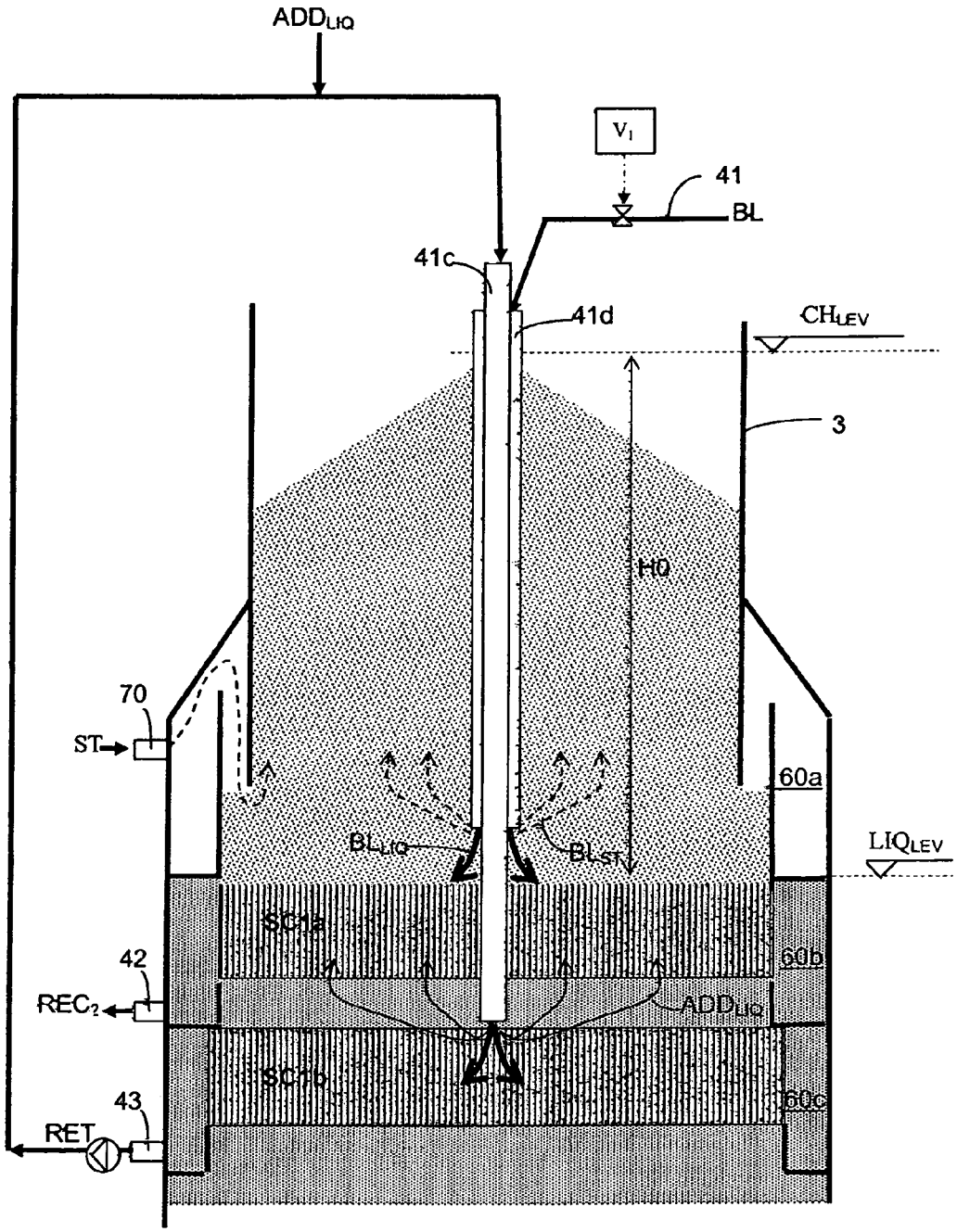
FIG. 5 shows an alternative embodiment of FIG. 2 with addition of dilution liquid to the second lower circulation.

In FIG. 5 is shown an alternative system according to FIG. 2, but where additional liquid $ADD_{LIQ}$ is added to the recirculation volumes from second withdrawal screen. This additional liquid $ADD_{LIQ}$ could preferably be obtained from flows REC1 or REC shown in FIG. 3.

The invention is not limited to the embodiments shown. Several variants are possible within the framework of the claims.

While the present invention has been described in accordance with preferred compositions and embodiments, it is to be understood that certain substitutions and alterations may be made thereto without departing from the spirit and scope of the following claims.

We claim:

1. A method for the impregnation and steaming of chips during the manufacture of chemical pulp, comprising;

continuously feeding chips without preceding steam treatment to a top of an impregnation vessel, adding hot impregnation fluid (BL) at a first temperature above a boiling point of the hot impregnation fluid to the impregnation vessel, the hot impregnation fluid being added via a pipe having an outlet end located below a chip level ($CH_{LEV}$) established in the impregnation vessel and at a distance from a wall of the impregnation vessel such that steam is released into the chip volume for steaming the chips, the added hot impregnation fluid (BL) establishing a fluid level ($LIQ_{LEV}$) in the impregnation vessel being at least 1-2 meters below the chip level ($CH_{LEV}$), establishing a pressure at the top of the impregnation vessel that is essentially at atmospheric pressure, ±0.5 bar(g), withdrawing a first impregnation fluid (REC) for a first use from a first withdrawal volume located at about the fluid level ($LIQ_{LEV}$) behind a first screen row mounted in the wall of the impregnation vessel, withdrawing a second impregnation fluid from a second withdrawal volume located behind a second screen row located a distance below the first screen row and mounted in the wall of the impregnation vessel, the distance below the first screen row not exceeding a diameter of the impregnation vessel, returning at least a part of the second impregnation fluid via the pipe into a center of the impregnation vessel, and feeding out impregnated chips from a bottom of the impregnation vessel.

2. The method according to claim 1, wherein the first use is for being part in a liquor flow sent to recovery, and not being part of fluid returned into the center of the impregnation vessel.

3. The method according to claim 2, wherein an amount of hot impregnation fluid (BL) fed in to the impregnation vessel in association with the fluid level exceeds 3 tonnes per tonne of wood and at a temperature of the impregnation fluid in an interval of 115-170° C., such that a temperature of a fluid-wood mixture that is established at the fluid level ($LIQ_{LEV}$) is established within an interval of 90-115° C. and wherein a level of alkali of the added impregnation fluid exceeds 15 g/l.

4. The method according to claim 3, wherein the amount of hot impregnation fluid (BL) fed in to the impregnation vessel in association with the fluid level exceeds 5 tonnes per tonne of wood and at a temperature of the impregnation fluid in an interval of 115-130° C.

5. The method according to claim 1, wherein an amount of second impregnation fluid withdrawn exceeds 0.5 tonnes per tonne of wood.

6. The method according to claim 5, wherein the part of the second impregnation fluid returned into the center of the impregnation vessel is at least 0.5 tonnes per tonne of wood.

7. The method according to claim 6, wherein the part of the second impregnation fluid returned into the center of the impregnation vessel is diluted with additional liquid ($ADD_{LIQ}$).

8. The method according to claim 7, wherein a total volume of the second impregnation fluid, including any dilution, is returned into the center of the impregnation vessel below the first screen row, and an upwardly directed displacement flow is established towards the first screen row.

9. A system for impregnating and steaming chips in one single impregnation vessel during the manufacture of chemical pulp, comprising, the impregnation vessel having an inlet defined therein at a top of the impregnation vessel for receiving chips and an outlet defined therein at a bottom of the impregnation vessel for discharging impregnated chips, the impregnation vessel having means for adding hot impregnation fluid (BL), at a first temperature above a boiling point of the hot impregnation fluid, to the impregnation vessel, a first central pipe having an outlet end located below a chip level ($CH_{LEV}$) established in the impregnation vessel and at a distance from a wall of the impregnation vessel, the outlet end being located at a center of the impregnation vessel for releasing steam into a chip volume for steaming the chips, the impregnation vessel having means for establishing a fluid level ($LIQ_{LEV}$) by the added impregnation fluid (BL) in the impregnation vessel, the impregnation vessel having means for establishing a chip level ($CH_{LEV}$) being at least 1-2 meters over the fluid level ($LIQ_{LEV}$), the impregnation vessel having means for establishing a pressure at the top of the impregnation vessel that is essentially at atmospheric pressure, ±0.5 bar, the impregnation vessel having a first screen row (SC1*a*) at about the fluid level ($LIQ_{LEV}$) comprising a first withdrawal volume located behind the first screen row (SC1*a*) mounted in the wall of the impregnation vessel for withdrawing spent impregnation fluid ($REC_2$), the impregnation vessel having an additional second screen row (SC1*b*) located at a distance below the first screen row, the impregnation vessel having a second withdrawal volume located behind the second screen row (SC1*b*) mounted in the wall of the impregnation vessel, the distance below the first screen row not exceeding a diameter of the impregnation vessel, a second withdrawal pipe in fluid communication with the second withdrawal volume for extracting spent treatment liquid, and the second withdrawal pipe being in fluid communication with a second central pipe, the second central pipe having an outlet in the impregnation vessel at the center of the impregnation vessel.

10. The system according to claim 9, wherein the outlet of the second central pipe is located below the first screen row.

11. The system according to claim 9, wherein a source of dilution liquid ($ADD_{LIQ}$) is in fluid communication with the second central pipe.

12. A withdrawal screen section for use in pre-treatment of chips in a liquor-vapor phase treatment vessel having a vapor phase at a top and a liquid phase at a bottom of the treatment vessel separated by a fluid level ($LIQ_{LEV}$), comprising, a first screen row (SC1*a*) mounted in a wall of the treatment vessel and located at about the fluid level ($LIQ_{LEV}$) and in contact with chips drenched in treatment liquid inside the treatment vessel, a first withdrawal volume arranged outside the first screen row for collecting treatment liquid withdrawn from the treatment vessel via the first screen row, a first withdrawal pipe in fluid communication with the first withdrawal volume for extracting spent treatment liquid via a first pump ($P_1$), an additional second screen row (SC1*b*) arranged at a distance below the first screen row, a second withdrawal volume arranged outside the second screen row for collecting treatment liquid withdrawn from the treatment vessel via the second screen row, a second withdrawal pipe in fluid communication with the second withdrawal volume for extracting spent treatment liquid via a second pump ($P_2$), the distance below the first screen row not exceeding a diameter of the impregnation vessel, the second withdrawal pipe in fluid communication with a second central pipe, the second central pipe having an outlet in the impregnation vessel at a center of the impregnation vessel.

13. A withdrawal screen according to claim 12, wherein the outlet of the second central pipe is located below the first screen row.

14. A method for the impregnation and steaming of chips during the manufacture of chemical pulp, comprising, continuously feeding chips without any preceding steam treatment to a top of an impregnation vessel, adding hot impregnation fluid (BL) at a first temperature above a boiling point of the hot impregnation fluid to the impregnation vessel, the hot impregnation fluid being added via a first pipe having an outlet end located below a chip level ($CH_{LEV}$) established in the impregnation vessel and at a distance from a wall of the impregnation vessel such that steam is released into the chip volume for steaming the chips, the added hot impregnation fluid (BL) establishing a fluid level ($LIQ_{LEV}$) in the impregnation vessel being at least 1-2 meters below the chip level ($CH_{LEV}$), establishing a pressure at the top of the impregnation vessel that is essentially at atmospheric pressure, ±0.5 bar(g), withdrawing a first impregnation fluid (REC) at about the fluid level ($LIQ_{LEV}$) from a first screen row, withdrawing a second impregnation fluid from a second screen row located a distance below the first screen row, the distance below the first screen row not exceeding a diameter of the impregnation vessel, returning at least a part of the second impregnation fluid via a second pipe having an outlet below the fluid level ($LIQ_{LEV}$) of the impregnation vessel, and feeding out impregnated chips from a bottom of the impregnation vessel.

* * * * *